United States Patent [19]

Röck

[11] Patent Number: 4,895,417

[45] Date of Patent: Jan. 23, 1990

[54] DRAWER SIDE WALL

[75] Inventor: Erich Röck, Höchst, Austria

[73] Assignee: Julius Blum Gesellschaft m.b.H., Höchst, Austria

[21] Appl. No.: 314,074

[22] Filed: Feb. 23, 1989

[30] Foreign Application Priority Data

Mar. 31, 1988 [AT] Austria ..... 854/88

[51] Int. Cl.[4] ..... A47B 88/00

[52] U.S. Cl. ..... 312/234.5; 312/330.1

[58] Field of Search ..... 312/234.5, 330 R, 341

[56] References Cited

U.S. PATENT DOCUMENTS

| | | | |
|---|---|---|---|
| 3,149,892 | 9/1964 | Barrow | 312/234.5 |
| 3,254,930 | 6/1966 | Becker | 312/234.5 X |
| 4,403,817 | 9/1983 | Aidar | 312/330 R |

*Primary Examiner*—Joseph Falk

*Attorney, Agent, or Firm*—Wenderoth, Lind & Ponack

[57] ABSTRACT

A drawer side wall of aluminum includes a vertical flange forming the lateral limitation of a drawer, a lower fastening flange for attachment of the bottom of the drawer and an upper horizontal running flange for a supporting roller to be mounted on the body of an article of furniture. At the front end of the drawer side wall, the vertical flange has formed therein a deformation positioned below an oblique or inclined portion of the running flange. The profile of the side wall of aluminum is injection molded or extruded. After such operation, the front end of the vertical flange of the drawer side wall is impressed to form the deformation, and thus, the horizontal flange is bent upwards.

16 Claims, 1 Drawing Sheet

DRAWER SIDE WALL

FIELD AND BACKGROUND OF THE INVENTION

The invention relates to a drawer side wall of metal, in particular of aluminum, comprising a vertical flange forming the lateral limitation of a drawer, a lower fastening flange for a drawer bottom and an upper horizontal running flange for a supporting roller mounted on the body of an article of furniture.

The invention further relates to a process for manufacturing such a drawer side wall, the side wall profile being injection molded or extruded with a continuously straight horizontal running flange of aluminum or the like.

Many drawers are injection molded, either as an integral piece of plastics material or assembled of individual structural members, i.e. two drawer side walls, a front panel, a rear wall and a bottom. In conventional drawers, the drawer side walls are provided with pull-out rails of a pull-out guide assembly which facilitates insertion and extraction of the drawer into or out of the body of the article of furniture.

Lately, there has been an increasing use of drawer side walls of metal, the running flange for the pull-out guide assembly being directly molded to such drawer side walls. Drawers of this type are advantageously of die cast or extruded aluminum.

It is also advantageous to provide the pull-out rails of a pull-out guide assembly, which are on the sides of the drawer, with a so-called run-in portion wherein, at the front end of each rail, the horizontal running flange thereof extends towards the front end of the drawer rail in an obliquely upward direction. When the roller on the side of the body comes to be within this region, the drawer is, by its own weight, automatically pressed backwards over the thus inclined portion of the running flange and is pulled into the body of the article of furniture. Even a drawer which has not been carefully closed will therefore not project from the body of the article of furniture.

SUMMARY OF THE INVENTION

It is the object of the invention to adapt a drawer side wall of the above-described type in such a manner that it can easily be provided with a run-in portion, and specifically with a suitable angled portion of the horizontal running flange.

According to the invention, this object is achieved by providing the vertical flange with an impressed recess caused by deformation at the front end of the drawer side wall, such recess thereby being below a sloped or inclined portion of the running flange.

A process according to the invention provides that, after an injection molding process and preferably after cutting of the thus molded member to form drawer side walls of desired length, the front ends of the vertical flanges are impressed or deformed to thereby form the recesses.

Due to the fact that the vertical flange of the drawer side wall is closely below the horizontal flange thereof, thus deformed, the running flange is pressed or deformed obliquely upwards by the yielding material of the vertical flange. The recess formed by such deformation is advantageously spaced from the front edge of the drawer side wall.

It is advantageously provided that the vertical flange has a box-shaped profile portion extending over part of its height and that such portion together with the running flange define a running groove for the supporting roller on the side of the furniture body, and that the recess formed by the deformation is positioned within said running groove.

One embodiment of the invention provides that the deformed portion defines a rectangular surface, when viewed from the side. This rectangular surface may advantageously be provided with a logo, for example the manufacturer's name. It is advantageously provided that the deformed portion forms a wedge-shaped recess in a horizontal sectional view of the vertical flange of the side wall, such recess having an oblique rear end. In this arrangement, the front end of the recess should have a depth of more than half the thickness of the vertical flange.

A further feature of the invention provides that the vertical flange is provided with a thickened portion above the recess.

BRIEF DESCRIPTION OF THE DRAWINGS

In the following an embodiment of the invention will be described in more detail with reference to the accompanying drawings, in which.

Figure 1:
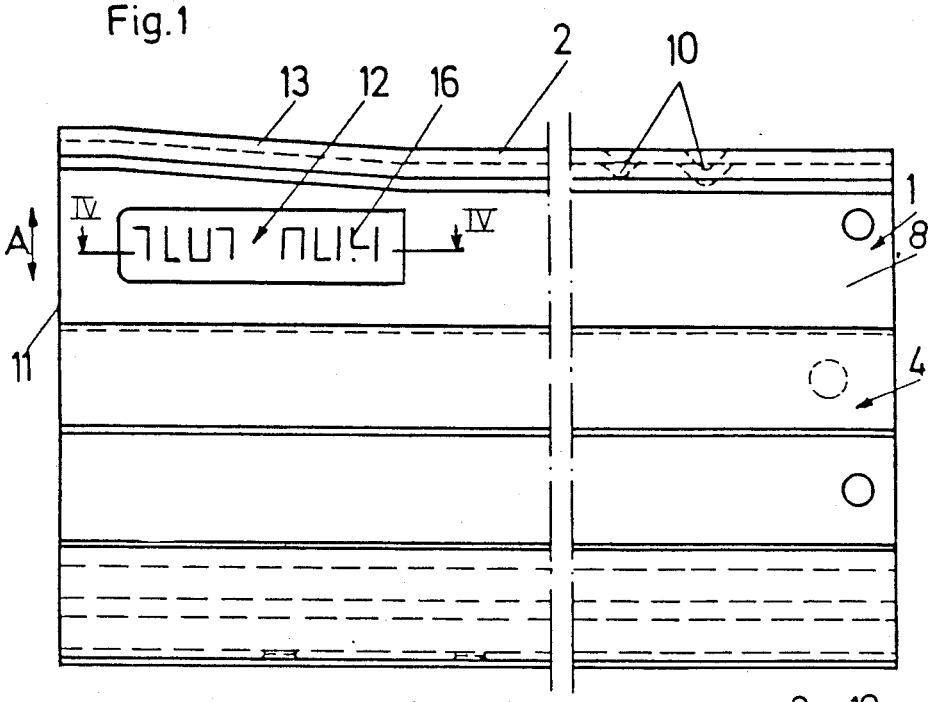
FIG. 1 is a side view of a drawer side wall according to the invention.
Figure 3:
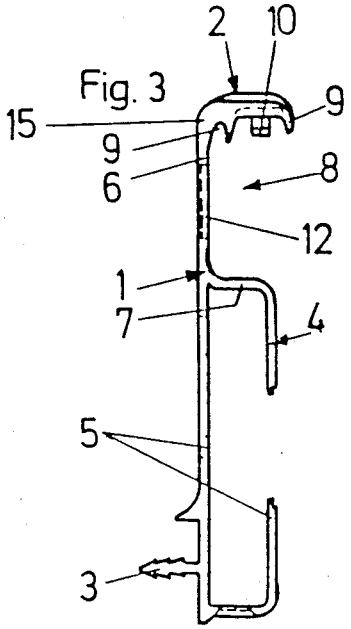
FIG. 3 is a front view of the drawer side wall according to the invention.
Figure 2:
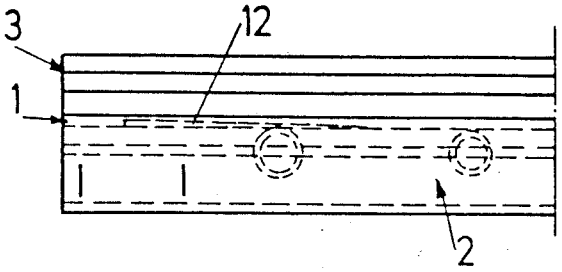
FIG. 2 is a top view of the front region of the drawer side wall according to the invention.

In the drawings, the other parts of the drawer, namely the front panel, the rear wall and the bottom, are not shown, because these parts and their connection with the drawer side wall are state of the art and are not the subject of the invention.

DESCRIPTION OF THE PREFERRED EMBODIMENTS

As already mentioned, the drawer side wall is preferably an extruded aluminum profile. It may, however, also be a different metal suited for the same type of processing.

The drawer side wall comprises a vertical flange 1 forming the lateral limitation of the drawer, an upper horizontal running flange 2 on which runs a roller (not shown) to be mounted on the side of a cabinet body, and a lower horizontal fastening flange 3 for fastening a bottom of the drawer to the drawer side wall.

The drawer side wall further includes a box-shaped profile portion 4 and thus has a double-walled region 5 and a region 6 which is formed by one wall only and which is part of the vertical flange 1. An upper horizontal flange 7 of the box-shaped profile portion 4 and the running flange 2 define a running groove 8 within which runs the roller to be mounted on the side of the cabinet body. The running flange 2 is further provided with lateral limiting flanges 9 which abut on both sides of such roller and thus improve the lateral stability and guiding of the drawer during sliding thereof. Moreover, the running flange 2 is, in a manner known per se, provided with stop members 10 which limit the extent of sliding of the drawer.

As can be seen from the drawings, the drawer side wall is, at a position close to the front edge 11 thereof, provided with a recess or deformation 12 that defines, as can be seen in FIG. 1, a rectangular surface when the side wall is viewed from the side. By means of the recess or deformation 12, the region 6 of the vertical flange 1 is extended in the direction of double arrow A, and this results in an inclined portion 13 thus formed at the running flange 2.

Figure 4:
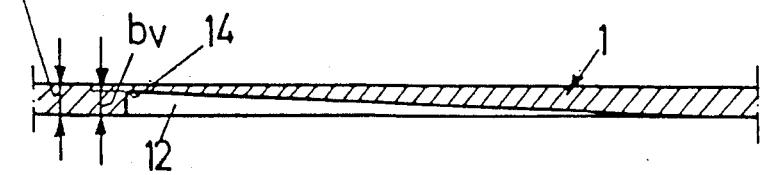
FIG. 4 is a sectional view along line IV—IV of FIG. 1.

As can particularly be seen from FIG. 4, the recess or deformation 12 in the vertical flange 1 is wedge-shaped and ends obliquely towards the rear, its maximum depth being at the front end 14. At the front end 14, the depth or breadth bv of the recess is less than the thickness bs of the vertical flange 1. Above the recess or deformation 12 the vertical flange 1 is provided with a thickened portion 15 which forms a transition to the running flange 2. The bottom of the recess or deformation 12 may be provided with indicia such as a logo 16 or the like.

What is claimed is:

1. A drawer side wall for incorporation into a drawer to be mounted for sliding movement into and out of the body of an article of furniture, said drawer side wall having upper and lower sides and forward and rearward ends and comprising:

a vertical flange to define a lateral limit of the drawer;

a lower fastening flange extending laterally from a lower portion of said vertical flange and to be used for attaching said drawer side wall to a bottom of the drawer;

an upper horizontal running flange extending laterally from an upper portion of said vertical flange and to run on a support roller to be mounted on the body of the article of furniture;

said vertical flange, said lower fastening flange and said upper running flange comprising an integral and unitary metal structure resulting from the injection molding or extrusion of said metal;

said vertical flange having formed therein, adjacent a forward end thereof, a recess;

said upper running flange having a forward portion inclined upwardly toward a forward end thereof; and said upwardly inclined forward portion of said upper running flange resulting from upward deformation of the metal of said vertical flange above said recess upon the formation of said recess by mechanical deformation into said vertical flange.

2. A drawer side wall as claimed in claim 1, further comprising an additional flange extending laterally from said vertical flange at a position spaced below said upper running flange, said upper running flange, said additional flange and an upper portion of said vertical flange thus defining a running groove for the support roller, and said recess being in said upper portion of said vertical flange.

3. A drawer side wall as claimed in claim 1, wherein said recess defines a rectangular surface when viewed from the side of said drawer side wall.

4. A drawer side wall as claimed in claim 3, further comprising indicia on said rectangular surface.

5. A drawer side wall as claimed in claim 1, wherein said recess is wedge-shaped as viewed in horizontal section through said vertical flange, said recess having a greatest depth at a front end thereof.

6. A drawer side wall as claimed in claim 5, wherein said depth of said front end of said recess is greater than half the thickness of said vertical flange.

7. A drawer side wall as claimed in claim 1, wherein said vertical flange has a thickened portion at a location above said recess.

8. A drawer side wall as claimed in claim 1, wherein said metal comprises aluminum.

9. A process for manufacturing a drawer side wall for incorporation into a drawer to be mounted for sliding movement into and out of the body of an article of furniture, said process comprising:

forming by injection molding or extrusion an integral and unitary metal structure including a vertical flange to define a lateral limit of the drawer, a lower fastening flange extending laterally from a lower portion of said vertical flange and to be used for attaching said drawer side wall to a bottom of the drawer, and an upper horizontal flange extending laterally from an upper portion of said vertical flange and to run on a support roller to be mounted on the body of the article of furniture; and mechanically deforming said vertical flange at a position adjacent a forward end thereof to thereby form a recess in said vertical flange, and thus deforming upwardly the metal of said vertical flange above said recess by an amount sufficient to cause a forward portion of said upper running flange to incline upwardly toward a forward end thereof.

10. A process as claimed in claim 9, wherein said metal comprises aluminum.

11. A process as claimed in claim 9, comprising forming said metal structure to include an integral additional flange extending laterally from said vertical flange at a position spaced below said upper running flange, and said mechanically deforming comprises forming said recess in a portion of said vertical flange above said additional flange.

12. A process as claimed in claim 9, comprising forming said recess to define a rectangular surface when viewed from the side of said drawer side wall.

13. A process as claimed in claim 12, further comprising providing indicia on said rectangular surface.

14. A process as claimed in claim 9, comprising forming said recess to be wedge-shaped as viewed in horizontal section through said vertical flange, with said recess having a greatest depth at a front end thereof.

15. A process as claimed in claim 14, comprising forming said recess such that said depth thereof at said front end thereof is greater than half the thickness of said vertical flange.

16. A process as claimed in claim 9, comprising forming said metal structure with said vertical flange having a thickened portion above said recess.

* * * * *